US010889995B2

(12) United States Patent
Midorikawa-Haelters et al.

(10) Patent No.: US 10,889,995 B2
(45) Date of Patent: Jan. 12, 2021

(54) TILED WALL ASSEMBLY

(71) Applicant: DUPONT SAFETY & CONSTRUCTION, INC., Wilmington, DE (US)

(72) Inventors: Yuka Midorikawa-Haelters, Langhorne, PA (US); Matthew Schmitt, Skillman, NJ (US); Donald Strum, Princeton, NJ (US); Robert Beale Van Varick, Yardley, PA (US); Barry D Olson, Williamsville, NY (US); Jeffrey Hutchins, Buffalo, NY (US); Kevin Urbanski, Petersburg, IL (US)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 0 days.

(21) Appl. No.: 16/582,352

(22) Filed: Sep. 25, 2019

(65) Prior Publication Data

US 2020/0131782 A1 Apr. 30, 2020

Related U.S. Application Data

(60) Provisional application No. 62/750,576, filed on Oct. 25, 2018.

(51) Int. Cl.

| | |
|---|---|
| ***E04F 13/08*** | (2006.01) |
| ***E04F 13/14*** | (2006.01) |
| ***E04F 13/18*** | (2006.01) |

(52) U.S. Cl.

CPC ..... *E04F 13/0889* (2013.01); *E04F 13/14* (2013.01); *E04F 13/18* (2013.01)

(58) Field of Classification Search

CPC ..... E04F 13/08; E04F 13/0889; E04F 13/14; E04F 13/18

See application file for complete search history.

(56) References Cited

U.S. PATENT DOCUMENTS 6,127,298 A 10/2000 Scarth et al.
8,375,663 B2 * 2/2013 Johnston ..... E04B 2/7422 52/287.1

(Continued)

FOREIGN PATENT DOCUMENTS

WO 2016/142647 A1 9/2016

OTHER PUBLICATIONS

Dupont™ Corian® Solid Surface Technical Bulletin, "DUPONT™ CORIAN® Interior Vertical Cladding", E.I. du Pont de Nemours and Company 2017.

*Primary Examiner* — Andrew J Triggs

(57) ABSTRACT

A wall assembly comprises a first sidewall, a second sidewall and a rear wall, wherein a plurality of non-porous tiles are affixed to the first sidewall, the second sidewall and the rear wall of the wall assembly. Each first sidewall tile, second sidewall tile, and rear wall tile extends the full length of one dimension of the first sidewall, the second sidewall, and the rear wall, respectively. Both upper and lower edges of the first sidewall tiles, second sidewall tiles, and rear wall tiles comprise a chamfer optionally terminating short of a first end and a second end of the first and second sidewall tiles and rear wall tiles. The rear wall tiles comprise a dado located at each end of the rear wall tile that provides a hidden connection with the first and second sidewall tiles. The first and second sidewall tiles and the rear wall tiles are of a synthetic or natural material.

16 Claims, 4 Drawing Sheets

(56) References Cited

U.S. PATENT DOCUMENTS

| | | | | |
|---|---|---|---|---|
| 9,376,802 | B2 * | 6/2016 | Tao | E04H 1/1266 |
| 9,518,392 | B2 * | 12/2016 | Morneau | B29C 70/305 |
| 10,273,697 | B2 * | 4/2019 | Horton | E04F 13/0866 |
| 10,563,410 | B2 * | 2/2020 | Horton | E04F 13/0871 |
| 2006/0080910 | A1 | 4/2006 | Cornia | |
| 2008/0250558 | A1 * | 10/2008 | Torres | A47K 3/30 4/614 |
| 2009/0133360 | A1 * | 5/2009 | Rippin | E04F 13/0862 52/749.11 |
| 2010/0186333 | A1 * | 7/2010 | Miller | E04F 19/045 52/483.1 |
| 2012/0005967 | A1 * | 1/2012 | Hourihan | A47K 3/008 52/35 |
| 2015/0300028 | A1 * | 10/2015 | Chase | E04F 13/0885 52/588.1 |
| 2018/0058076 | A1 * | 3/2018 | Horton | E04F 13/0866 |
| 2020/0131782 | A1 * | 4/2020 | Midorikawa-Haelters | E04F 13/0894 |

* cited by examiner

TILED WALL ASSEMBLY

BACKGROUND OF THE INVENTION

1. Field of the Invention

This invention pertains to a tiled wall assembly suitable for use in areas where fluids can splash on the tiles. Such areas include showers, bathrooms, closets, coves, surgical rooms, kitchens and other wet rooms.

Traditionally, grout has been used to fill in the spaces between adjacent wall tiles. However, the grout frequently becomes discolored requiring cleaning and/or sections of grout break away and require replacement. There is an ongoing need therefore to provide tiled wall assemblies that do not require grout.

2. Description of Related Art

PCT publication WO 2016/142647 A1 to Horton et al describes a wall panel suitable for bathrooms, wet rooms and the like. The panel is water impervious and comprises a core of wood plastics composite (WPC) and a laminate adhesively attached to the core. In preferred embodiments, the core is a wood plastics composite foamed board. The wood plastics composite preferably comprises PVC and wood fiber. The wall panel may be provided with a tongue-and-groove interlocking system with tongue and groove edges. The system is configured to provide a contact area across less than the thickness of the panel which achieves a tight join at the front face and eliminates a visible gap. It also increases tolerance for machining errors or variation. The tongue-and-groove interlocking system is designed to provide tolerance for walls which are not precisely planar but may be bowed or uneven to a certain extent.

United States Publication 2006/0080910 to Silvano discloses a tile system that does not require a grout or other material to be spread over the tiles during the installation process. Accordingly, the tile system includes tiles that carry a flange that attaches to adjacent tiles upon installation. The flange serves the function of the grout and eliminates the need for a separate grout compound. A tile in accordance with the invention includes a primary tile component and a flange for attaching for other tiles.

BRIEF SUMMARY OF THE INVENTION

In a first embodiment, a wall assembly comprises a first sidewall, a second sidewall, and a rear wall, wherein: a plurality of non-porous tiles are affixed to the first sidewall, the second sidewall, and the rear wall of the wall assembly, said wall assembly thereby comprising first sidewall tiles, second sidewall tiles, and rear wall tiles; each first sidewall tile, second sidewall tile and rear wall tile extends the full length of one dimension of the first sidewall, the second sidewall, and the rear wall, respectively; both upper and lower edges of the first sidewall tiles, second sidewall tiles and rear wall tiles comprise a chamfer optionally terminating short of a first end and a second end of the first sidewall tiles, second sidewall tiles, and rear wall tiles; each rear wall tile comprising a dado located at each end of the rear wall tile that provides a hidden connection with the first sidewall tiles and second sidewall tiles; and the first sidewall tiles, second sidewall tiles and the rear wall tiles are of a synthetic or natural material.

In a second embodiment, a wall assembly comprises a first sidewall, a second sidewall, and a front wall, wherein: a plurality of non-porous tiles are affixed to the first sidewall, the second sidewall, and the front wall of the wall assembly, said wall assembly thereby comprising first sidewall tiles, second sidewall tiles, and front wall tiles; each first sidewall tile, second sidewall tile and front wall tile extends the full length of one dimension of the first sidewall, the second sidewall, and the front wall, respectively, except where there is an opening in the front wall; the upper and lower edges of the first sidewall tiles, the second sidewall tiles, and front wall tiles comprise a chamfer optionally terminating short of a first end and a second end of the first sidewall tiles, second sidewall tiles, and front wall tiles; each front wall tile comprising a dado located at one or both ends of the front wall tile that provides a hidden connection with the first sidewall tiles and second sidewall tiles; and the first sidewall tiles, second sidewall tiles, and the front wall tiles are of a synthetic or natural material.

In a third embodiment, a wall assembly comprises a first sidewall, a second sidewall, and a rear wall, wherein: a plurality of non-porous tiles are affixed to the first sidewall, the second sidewall and the rear wall of the wall assembly, said wall assembly thereby comprising first sidewall tiles, second sidewall tiles, and rear wall tiles; each first sidewall tile, second sidewall tile and rear wall tile extends the full length of one dimension of the first sidewall, the second sidewall and the rear wall, respectively; the upper and lower edges of the first sidewall tiles, the second sidewall tiles and rear wall tiles comprise a chamfer optionally terminating short of a first end, and a second end of the first sidewall tiles, second sidewall tiles, and rear wall tiles; the first sidewall tiles and second sidewall tiles are scribed and cut to butt against the rear wall tiles; and the first sidewall tiles, the second sidewall tiles and the rear wall tiles are of a synthetic or natural material.

In a fourth embodiment, a wall assembly comprises a first sidewall, a second sidewall, and a front wall, wherein: a plurality of non-porous tiles are affixed to the first sidewall, the second sidewall, and the front wall of the wall assembly, said wall assembly thereby comprising first sidewall tiles, second sidewall tiles, and front wall tiles; each first sidewall tile, second sidewall tile and front wall tile extends the full length of one dimension of the first sidewall, the second sidewall and the front wall, respectively, except where there is an opening in the front wall; the upper and lower edges of the first sidewall tiles, second sidewall tiles, and front wall tiles, comprises a chamfer optionally terminating short of a first end and a second end of the first sidewall tiles, second sidewall tiles, and front wall tiles; the first sidewall tiles, and second sidewall tiles are scribed and cut to butt against the front wall tiles; and the first sidewall tiles, the second sidewall tiles, and the front wall tiles are of a synthetic or natural material.

DETAILED DESCRIPTION OF THE INVENTION

While the present invention is capable of being embodied in various forms, the description below of several embodiments is made with the understanding that the present disclosure is to be considered as an exemplification of the invention, and is not intended to limit the invention to the specific embodiments illustrated. Headings are provided for convenience only and are not to be construed to limit the invention in any manner. Embodiments illustrated under any heading or in any portion of the disclosure may be combined with embodiments illustrated under the same or any other heading or other portion of the disclosure.

Any combination of the elements described herein in all possible variations thereof is encompassed by the invention unless otherwise indicated herein or otherwise clearly contradicted by context. For example, if a wall assembly described in an embodiment may vary according to an additional feature or claim element, it is to be understood that other wall assemblies described in other embodiments may also vary according to that same additional feature or claim element unless otherwise indicated herein or otherwise clearly contradicted by context.

As used herein, the term "chamfer" refers to a cut on the edge or corner of something, such as a tile, that makes it slope slightly rather than being perfectly square.

As used herein, the term "dado" refers to a rectangular groove cut into a tile edge so that a like piece may be fitted into it.

As used herein, the term "extends the full length of the wall" means that the longest dimension of the tile runs from wall to wall and therefore runs the full length of one dimension of the wall it covers.

By "non-porous tile" is meant that fluid remains on the surface of the tile or runs off the tile with no penetration of fluid into the tile (such as, for example, less than 0.5 percent by weight absorption of fluid into the tile; or less than 0.1 percent by weight absorption; or less than 0.01 percent by weight absorption).

Wall Assembly

Figure 1:
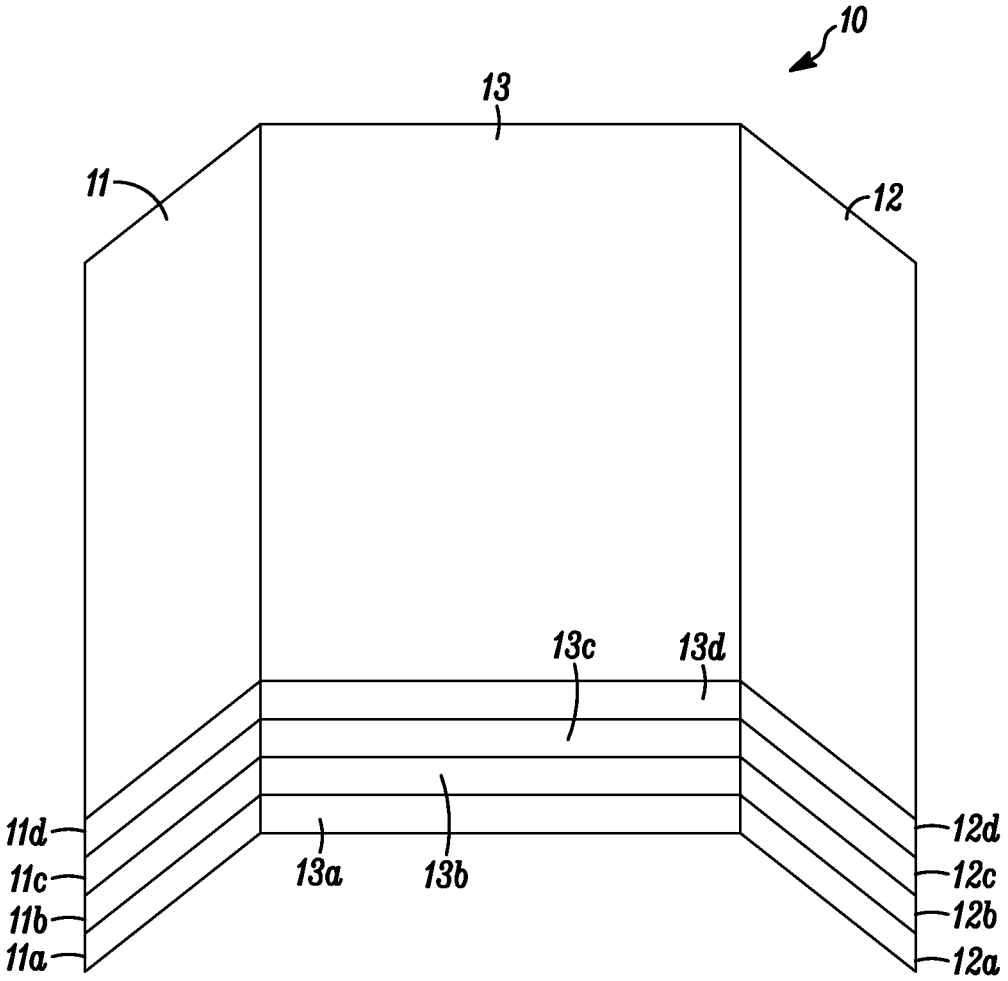
FIG. 1 shows a perspective view of a tiled wall assembly according to one embodiment of this invention.

FIG. 1 shows a wall assembly of one embodiment of this invention. The assembly comprises a first side wall 11, a second sidewall 12 and a rear wall 13. Affixed to the first and second sidewalls and the rear wall are a plurality of non-porous tiles 11*a*-11*d*, 12*a*-12*d* and 13*a*-13*d* respectively. For convenience, only four tiles are shown in each of the walls but the number of tiles affixed will depend on the height of each wall requiring protection from fluid (and the width dimension of the tile).

In a preferred embodiment, each first and second sidewall tile and each rear wall tile extends the full length of one dimension of the first and second sidewalls and the rear wall, respectively. For example, If the tile dimensions are given by the tile length×tile width×tile thickness (with tile length>tile width), and the wall area to be covered (for example, a sidewall, or the rear wall), has wall dimensions given by the wall length×wall width (with wall length>wall width), then the length dimension of the tile extends the full length of one of the wall dimensions (the Figures show the tile length dimension extends the full length of the wall width dimension, although the tile length dimension could alternatively extend the full length of the wall length dimension—that is, the tile length could run horizontally as shown in the Figures, or it could run vertically).

The wall assembly is free of grout between adjacent tiles.

Figure 4:
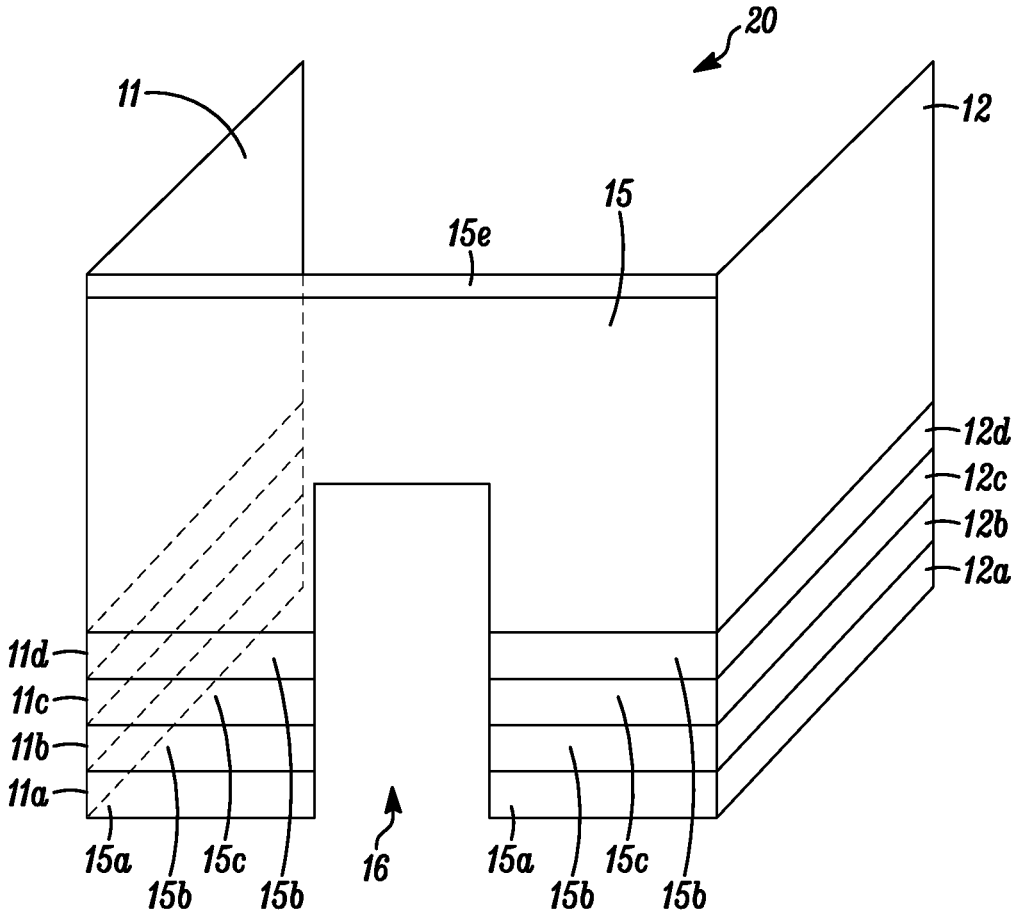
FIG. 4 shows a perspective view of a tiled wall assembly according to another embodiment of this invention.

FIG. 4 shows a wall assembly of another embodiment of this invention. This variant of the assembly comprises a first side wall 11, a second sidewall 12 and a front wall 15. Affixed to the first and second sidewalls and the front wall are a plurality of non-porous tiles 11*a*-11*d*, 12*a*-12*d* and 15*a*-15*e* respectively. For convenience, only four tiles are shown in each of the side walls and five tiles for the front wall but the number of tiles affixed will depend on the height of each wall requiring protection from fluid (and the width dimension of the tile, if horizontally positioned).

In a preferred embodiment, each first and second sidewall tile and each front wall tile extends the full length of one dimension of the first and second sidewalls and the front wall except where there is an opening 16 in the front wall. In this instance the front tiles, e.g. 15*a*-15*d* terminate at the front wall opening. In FIG. 4, 15*e* is an example of a front wall tile extending the full length of one dimension of the front wall.

The wall assembly is free of grout between adjacent tiles.

Sidewall Tile

Figure 2:
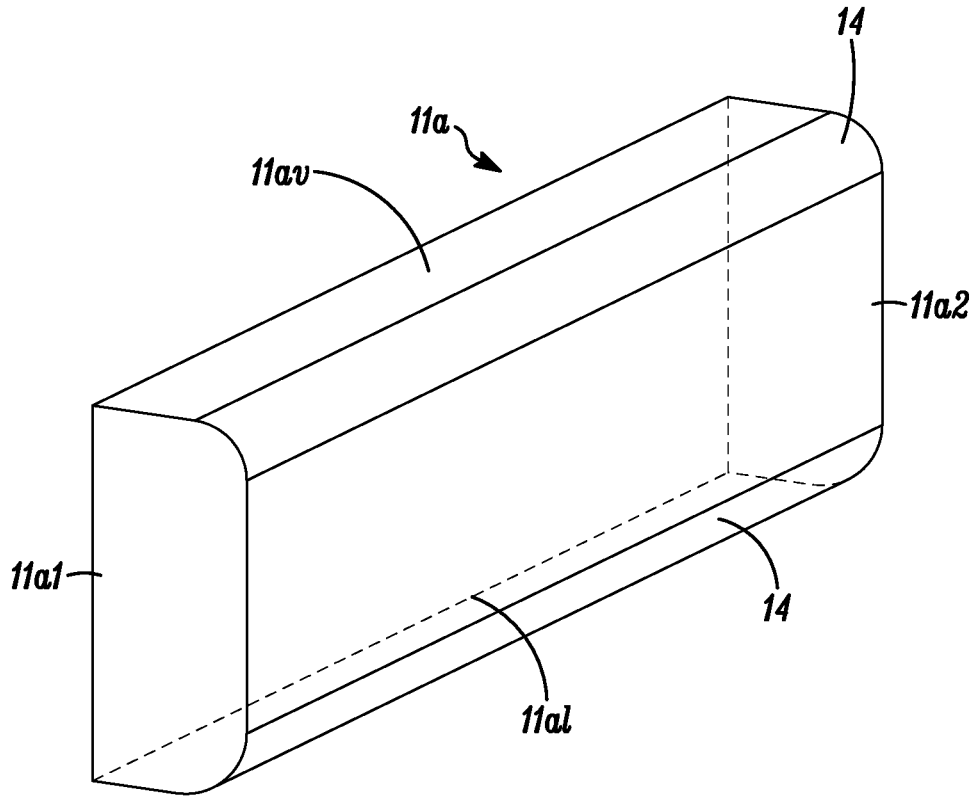
FIG. 2 shows a view of a sidewall tile according to this invention.

FIG. 2 shows an embodiment of one of the first and second sidewall tiles. An example of tile 11*a* is shown. The tile comprises an upper edge 11*au*, a lower edge 11*al*, a first end 11*a*1 and a second end 11*a*2. A chamfer 14 is on both the upper front edge 11*au* and lower front edge 11*al* of the tile. In some embodiments, the chamfers terminate short of the first and/or second ends of the tile. In FIG. 2, the chamfer is shown as running the full length of the sidewall tile. The function of the chamfer is to allow adjacent vertical tile surfaces to be out of plane without it being visible or obvious. If the tiles were merely butted together, slight planar offsets such as from about 0.010-0.030 inches (0.25-0.76 mm) would become noticeable.

Rear Tile

Figure 3:
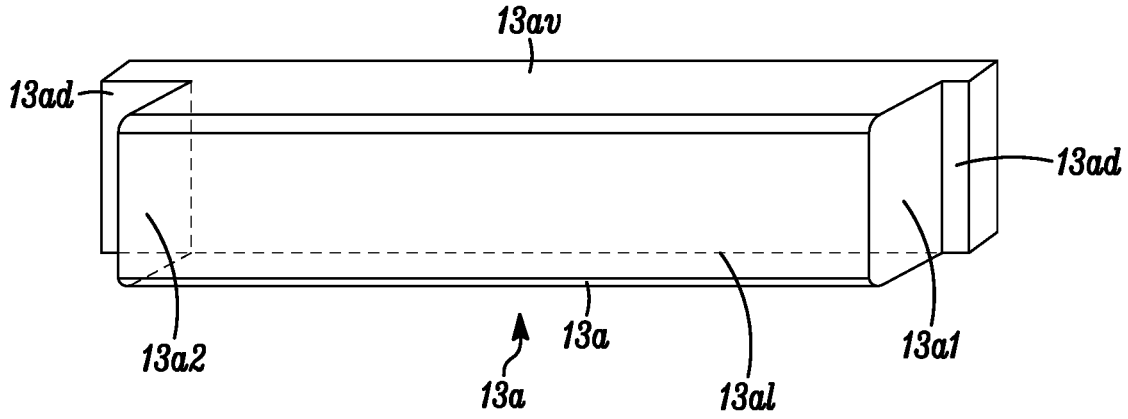
FIG. 3 shows a view of a rear wall tile according to this invention.

FIG. 3 shows an embodiment of one of the rear wall tiles. An example of tile 13*a* is shown. The tile comprises an upper edge 13*au*, a lower edge 13*a*1, a first end 13*a*1 and a second end 13*a*2. In an embodiment, the tile further comprises a dado located at each end 13*a*1 and 13*a*2 of the tile. The dado is shown as 13*ad*. A dado is a groove cut in the face of the rear wall the into which the edge of a sidewall the is fixed. Dado is a term well known in the woodworking art. In the present invention, the dado also provides a hidden connection between the saw tooth gap at the intersection of a sidewall the and a rear wall tile. The function of the dado is to hide any vertical misalignment between the end plane of the first and second sidewall tiles and the face plane of the rear tiles. In another embodiment, the tile comprises a dado located at only one end 13*a*1 or 13*a*2 of each side and rear wall tile. In yet another embodiment, there is no dado located at either end of the rear tile. In embodiments where there is no dado on the rear wall tile, the first and second sidewall tiles are scribed and cut to butt against the back wall tiles.

In a similar manner as described for the sidewall tiles, the rear wall tiles are chamfered on both the top and bottom edges. The chamfer may extend over the full length of the tile or terminate short of the tile ends.

Front Wall Tile

In parts of the front wall where there is no opening 16, the front wall tile is as described for the rear wall tile of FIG. 3. In parts of the front wall where there is an opening 16, the front wall tile only has a single dado that is located at the end of the front tile that contacts the first or second sidewall tiles i.e. there may be a dado at one or both ends of the front wall tile depending on the location of the tile on the front wall.

In a similar manner as described for the sidewall tiles, the front wall tiles are chamfered on both the top and bottom edges. The chamfer may extend over the full length of the tile or terminate short of the tile ends.

In some embodiments, the sidewall tiles, the front tiles and the rear tiles comprise a tongue and groove feature. The tongue is normally on the upper edge of the tile and the groove in the lower edge although the position of these two features may be reversed. In an alternative embodiment, vertically adjacent tiles may overlap each other. Other terms for an overlap are ship-lap, cleated-lap and flange.

Tile Composition

The first and second sidewall tiles and the rear and front wall tiles are of a synthetic or natural material. Examples of synthetic materials include polymeric materials and ceramic or porcelain materials. Examples of natural tiles are stone, marble and granite.

Ceramics are generally made by taking mixtures of clay, earthen elements, powders, and water and shaping them into desired forms. Once the ceramic has been shaped, it is fired in a high temperature oven such as a kiln. Often, ceramics are covered in a glaze. An exemplary composition for a ceramic the is described in U.S. Pat. No. 6,127,298 A.

Acrylic or polyester polymeric resins are particularly suitable for synthetic tiles especially those based on polymethylmethacrylate or unsaturated polyester. Combinations of polymethylmethacrylate and unsaturated polyester also have utility. Typically, the resin comprises from 45 to 80 volume fraction percent of polymethylmethacrylate or unsaturated polyester and from 25 to 55 volume fraction percent of inorganic filler particles distributed evenly throughout the resin. Polymethylmethacrylate (PMMA) arises from polymerization of methylmethacrylate. Quartz may also be a component of the polymeric tile materials for example a PMMA/quartz blend. These synthetic resins can be cast or molded and cured to produce a sheet structure suitable for tiles. Exemplary polymeric materials used in solid surfaces are available under the tradename CORIAN®, HI-MACs®, WILSONART®, STARON®, KRION®, SILESTONE®or CAMBRIA®.

Preferably the first and second sidewall tiles and the rear and front wall tiles are "wood workable". By this is meant that the tiles can be easily cut with graphite tipped tools. A synthetic (polymeric) tile having a Mohs hardness of from 1 to 4, or even 1.5 to 3.5, is deemed to be wood workable.

The first and second sidewall tiles and the rear and front wall tiles are affixed to the wall by adhesive, cement or some other bonding means.

Assembling the Wall Tiles

The wall tiles are assembled using techniques well known to those skilled in the art but are summarized as follows. A backwall tile is the first to be installed, followed by side wall tiles. The backwall tile has dado grooves on both ends the sidewall tiles fit into. The side wall tiles are shimmed to fit tight to the length of the backwall tile to create a tight uniform vertical corner between tiles. Preferably, the horizontal chamfers along the top and bottom edges of tiles are truncated short of the tile ends, to create symmetric corners with the truncated chamfer ends stacked in vertical alignment.

Preferably, a silicone adhesive is used to bond the tiles to the wall.

Design Options

Various design options provide differing advantages.

Figure 5:
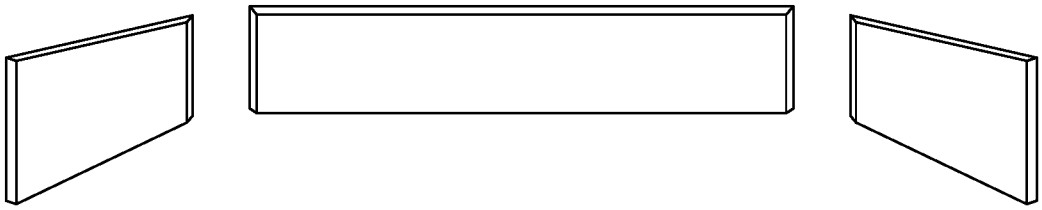
FIG. 5 shows a view of a first tile design option.

A first option, as shown in FIG. 5, which has dados at both ends of the rear tile and a chamfer truncated short of the tile ends eliminates the chamfer groove going into corners thus providing a potential to eliminate the need for sealant.

Figure 6:
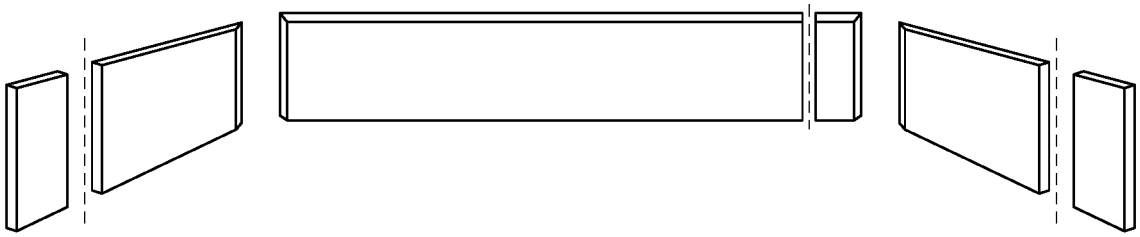
FIG. 6 shows a view of a second tile design option.

FIG. 6 shows a second option in which there is a single dado at the left end of each rear tile. This requires a full-length chamfer. The advantage of this concept is that there is no need to adjust the wall to ensure that it is plumb.

In a third option, the rear tiles have no dados and the chamfers are full length. The sidewall tiles can be scribed and cut to fit any backwall tile. The advantage here is also that there is no need to adjust the wall to ensure that it is plumb.

Referring to the Figures, some non-limiting exemplary embodiments are presented below:

In an embodiment, there is provided a wall assembly 10 comprising a first sidewall 11, a second sidewall 12, and a rear wall 13, wherein: a plurality of non-porous tiles 11*a*-11*d*, 12*a*-12*d*, 13*a*-13*d* are affixed to the first sidewall, the second sidewall, and the rear wall, respectively, of the wall assembly, said wall assembly thereby comprising first sidewall tiles, second sidewall tiles, and rear wall tiles; each first sidewall tile, second sidewall tile and rear wall tile extends the full length of one dimension of the first sidewall, the second sidewall, and the rear wall, respectively; both upper, u, and lower, I, edges of the first sidewall tiles, 11*au*-11*du* and 11*al*-11*dl*, and second sidewall tiles, 12*au*-12*du* and 12*al*-12*dl*, and rear wall tiles, 13*au*-13*du* and 13*al*-13*dl*, comprise a chamfer 14 optionally terminating short of a first end, 11*a*1-11*d*1, 12*a*1-12*d*1, 13*a*1-13*d*1, and a second end, 11*a*2-11*d*2, 12*a*2-12*d*2, 13*a*2-13*d*2, of the first sidewall tiles, second sidewall tiles, and rear wall tiles; each rear wall tile comprising a dado 13*ad* located at each end of the rear wall tile that provides a hidden connection with the first sidewall tiles and second sidewall tiles; and the first sidewall tiles, second sidewall tiles and the rear wall tiles are of a synthetic or natural material.

In an embodiment, the first sidewall tiles, second sidewall tiles and the rear wall tiles have a Mohs hardness of from 1 to 4.

In an embodiment, the synthetic material of the first sidewall tiles, second sidewall tiles and the rear wall tiles is polymeric or ceramic.

In an embodiment, the polymeric material of the first sidewall tiles, second sidewall tiles and the rear wall tiles comprises an acrylic polymer, unsaturated polyester, or a combination thereof.

In an embodiment, the polymeric material of the first sidewall tiles, second sidewall tiles and the rear wall tiles comprises polymethylmethacrylate, unsaturated polyester, or a combination thereof.

In an embodiment, the polymeric material of the first sidewall tiles, second sidewall tiles and the rear wall tiles comprises polymethylmethacrylate and quartz.

In an embodiment, there is provided a shower, closet or cove comprising the wall assembly described herein.

In an embodiment, the wall assembly is free of grout between adjacent tiles.

In another embodiment, there is provided a wall assembly 20 comprising a first sidewall 11, a second sidewall 12, and a front wall 15, wherein: a plurality of non-porous tiles 11*a*-11*d*, 12*a*-12*d*, 15*a*-15*e* are affixed to the first sidewall, second sidewall, and the front wall, respectively, of the wall assembly, said wall assembly thereby comprising first sidewall tiles, second sidewall tiles, and front wall tiles; each first sidewall tile, second sidewall tile and front wall tile extends the full length of one dimension of the first sidewall, the second sidewall, and the front wall, respectively, except where there is an opening in the front wall; the upper, u, and lower, I, edges of the first sidewall tiles, 11*au*-11*du* and 11*al*-11*dl*, and second sidewall tiles, 12*au*-12*du* and 12*al*-12*dl*, and front wall tiles, 15*au*-15*eu* and 15*a*1-15*e*1, comprise a chamfer 14 optionally terminating short of a first end, 11*a*1-11*d*1, 12*a*1-12*d*1, 15*al*-15*el*, and a second end, 11*a*2-11*d*2,12*a*2-12*d*2, 15*a*2-15*e*2, of the first sidewall tiles, second sidewall tiles, and front wall tiles; each front wall tile comprising a dado 15*ad* located at one or both ends of the front wall tile that provides a hidden connection with the first sidewall tiles and second sidewall tiles; and the first sidewall tiles, the second sidewall tiles, and the front wall tiles are of a synthetic or natural material.

In an embodiment, the first sidewall tiles, the second sidewall tiles and the front wall tiles have a Mohs hardness of from 1 to 4.

In an embodiment, the synthetic material of the first sidewall tiles, the second sidewall tiles and the front wall tiles is polymeric or ceramic.

In an embodiment, the polymeric material of the first sidewall tiles, the second sidewall tiles and the front wall tiles comprises an acrylic polymer, unsaturated polyester, or a combination thereof.

In an embodiment, the polymeric material of the first sidewall tiles, the second sidewall tiles and the front wall tiles comprises polymethylmethacrylate, unsaturated polyester, or a combination thereof.

In an embodiment, the polymeric material of the first sidewall tiles, the second sidewall tiles and the front wall tiles comprises polymethylmethacrylate and quartz.

In an embodiment, there is provided a shower, closet or cove comprising the wall assembly described herein.

In an embodiment, the wall assembly is free of grout between adjacent tiles.

In another embodiment, there is provided a wall assembly 10 comprising a first sidewall 11, a second sidewall 12, and a rear wall 13, wherein: a plurality of non-porous tiles 11*a*-11*d*, 12*a*-12*d*, 13*a*-13*d* are affixed to the first sidewall, the second sidewall and the rear wall, respectively, of the wall assembly, said wall assembly thereby comprising first sidewall tiles, second sidewall tiles, and rear wall tiles; each first sidewall tile, second sidewall tile and rear wall tile extends the full length of one dimension of the first sidewall, the second sidewall and the rear wall, respectively; the upper, u, and lower, I, edges of the first sidewall tiles, 11*au*-11*du* and 11*al*-11*dl*, and second sidewall tiles, 12*au*-12*du* and 12*al*-12*dl*, and rear wall tiles, 13*au*-13*du* and 13*al*-13*dl*, comprise a chamfer 14 optionally terminating short of a first end, 11*a*1-11*d*1, 12*a*1-12*d*1, 13*a*1-13*d*1, and a second end, 11*a*2-11*d*2, 12*a*2-12*d*2, 13*a*2-13*d*2, of the first sidewall tiles, the second sidewall tiles, and rear wall tiles; the first sidewall tiles and the second sidewall tiles are scribed and cut to butt against the rear wall tiles, and the first sidewall tiles, the second sidewall tiles and the rear wall tiles are of a synthetic or natural material.

In another embodiment, there is provided a wall assembly 20 comprising a first sidewall 11, a second sidewall 12, and a front wall 15, wherein: a plurality of non-porous tiles 11*a*-11*d*, 12*a*-12*d*, 15*a*-15*e* are affixed to the first sidewall, the second sidewall, and the front wall, respectively, of the wall assembly, said wall assembly thereby comprising first sidewall tiles, second sidewall tiles, and front wall tiles; each first sidewall tile, second sidewall tile and front wall tile extends the full length of one dimension of the first sidewall, the second sidewall and the front wall, respectively, except where there is an opening in the front wall; the upper, u, and lower, I, edges of the first sidewall tiles, 11*au*-11*du* and 11*al*-11*dl*, second sidewall tiles, 12*au*-12*du* and 12*al*-12*dl*, and front wall tiles, 15*au*-15*eu* and 15*al*-15*el*, comprises a chamfer 14 optionally terminating short of a first end 11*a*1-11*d*1, 12*a*1-12*d*1, 15*a*1-15*e*1, and a second end 11*a*2-11*d*2, 12*a*2-12*d*2, 15*a*2-15*e*2, of the first sidewall tiles, second sidewall tiles, and front wall tiles; the first sidewall tiles, and second sidewall tiles are scribed and cut to butt against the front wall tiles, and the first sidewall tiles, second sidewall tiles, and the front wall tiles are of a synthetic or natural material.

We claim:

1. A wall assembly comprising a first sidewall, a second sidewall, and a rear wall, wherein a plurality of non-porous tiles are affixed to the first sidewall, the second sidewall, and the rear wall of the wall assembly, said wall assembly thereby comprising first sidewall tiles, second sidewall tiles, and rear wall tiles, each tile having upper and lower edges, each first sidewall tile, second sidewall tile and rear wall tile is positioned such that a longest dimension of the tile extends in a horizontal direction across a full length of said first sidewall, said second sidewall or said rear wall respectively, both upper and lower edges of the first sidewall tiles, second sidewall tiles and rear wall tiles comprise a chamfer optionally terminating short of a first end and a second end of the first sidewall tiles, second sidewall tiles, and rear wall tiles, each rear wall tile comprising a dado located at each end of the rear wall tile that provides a hidden connection with the first sidewall tiles and second sidewall tiles, and the first sidewall tiles, second sidewall tiles and the rear wall tiles are of a synthetic or natural material, and wherein the wall assembly is free of grout between adjacent tiles.

2. The wall assembly of claim 1 wherein the first sidewall tiles, second sidewall tiles and the rear wall tiles have a Mohs hardness of from 1 to 4.

3. The wall assembly of claim 1 wherein the synthetic material of the first sidewall tiles, second sidewall tiles and the rear wall tiles is polymeric or ceramic.

4. The wall assembly of claim 3 wherein the polymeric material of the first sidewall tiles, second sidewall tiles and the rear wall tiles comprises an acrylic polymer, unsaturated polyester, or a combination thereof.

5. The wall assembly of claim 4 wherein the polymeric material of the first sidewall tiles, second sidewall tiles and the rear wall tiles comprises polymethylmethacrylate, unsaturated polyester, or a combination thereof.

6. The wall assembly of claim 5 wherein the polymeric material of the first sidewall tiles, second sidewall tiles and the rear wall tiles comprises polymethylmethacrylate and quartz.

7. A shower, closet or cove comprising the wall assembly of claim 1.

8. A wall assembly comprising a first sidewall, a second sidewall, and a front wall, wherein a plurality of non-porous tiles are affixed to the first sidewall, the second sidewall, and the front wall of the wall assembly, said wall assembly thereby comprising first sidewall tiles, second sidewall tiles, and front wall tiles, each tile having upper and lower edges, each first sidewall tile, second sidewall tile and front wall tile is positioned such that a longest dimension of the tile extends in a horizontal direction across a full length of said first sidewall, said second sidewall or said rear wall respectively, except where there is an opening in the front wall, the upper and lower edges of the first sidewall tiles, the second sidewall tiles, and front wall tiles comprise a chamfer optionally terminating short of a first end and a second end of the first sidewall tiles, second sidewall tiles, and front wall tiles, each front wall tile comprising a dado located at one or both ends of the front wall tile that provides a hidden connection with the first sidewall tiles and second sidewall tiles, and the first sidewall tiles, second sidewall tiles, and the front wall tiles are of a synthetic or natural material, and wherein the wall assembly is free of grout between adjacent tiles.

9. The wall assembly of claim 8 wherein the first sidewall tiles, the second sidewall tiles and the front wall tiles have a Mohs hardness of from 1 to 4.

10. The wall assembly of claim 8 wherein the synthetic material of the first sidewall tiles, second sidewall tiles and the front wall tiles is polymeric or ceramic.

11. The wall assembly of claim 10 wherein the polymeric material of the first sidewall tiles, second sidewall tiles and the front wall tiles comprises an acrylic polymer, unsaturated polyester, or a combination thereof.

12. The wall assembly of claim 11 wherein the polymeric material of the first sidewall tiles, second sidewall tiles and the front wall tiles comprises polymethylmethacrylate, unsaturated polyester, or a combination thereof.

13. The wall assembly of claim 12 wherein the polymeric material of the first sidewall tiles, second sidewall tiles and the front wall tiles comprises polymethylmethacrylate and quartz.

14. A shower, closet or cove comprising the wall assembly of claim 8.

15. A wall assembly comprising a first sidewall, a second sidewall, and a rear wall, wherein a plurality of non-porous tiles are affixed to the first sidewall, the second sidewall and the rear wall of the wall assembly, said wall assembly thereby comprising first sidewall tiles, second sidewall tiles, and rear wall tiles, each tile having upper and lower edges, each first sidewall tile, second sidewall tile and rear wall tile is positioned such that a longest dimension of the tile extends in a horizontal direction across a full length of said first sidewall, said second sidewall or said rear wall respectively, the upper and lower edges of the first sidewall tiles, the second sidewall tiles and rear wall tiles comprise a chamfer optionally terminating short of a first end, and a second end of the first sidewall tiles, second sidewall tiles, and rear wall tiles, the first sidewall tiles and second sidewall tiles are scribed and cut to butt against the rear wall tiles, and the first sidewall tiles, the second sidewall tiles and the rear wall tiles are of a synthetic or natural materials, and wherein the wall assembly is free of grout between adjacent tiles.

16. A wall assembly comprising a first sidewall, a second sidewall, and a front wall, wherein a plurality of non-porous tiles are affixed to the first sidewall, the second sidewall, and the front wall of the wall assembly, said wall assembly thereby comprising first sidewall tiles, second sidewall tiles, and front wall tiles, each tile having upper and lower edges, each first sidewall tile, second sidewall tile and front wall tile is positioned such that a longest dimension of the tile extends in a horizontal direction across a full length of said first sidewall, said second sidewall or said rear wall respectively, except where there is an opening in the front wall, the upper and lower edges of the first sidewall tiles, second sidewall tiles, and front wall tiles, comprises a chamfer optionally terminating short of a first end and a second end of the first sidewall tiles, second sidewall tiles, and front wall tiles, the first sidewall tiles, and second sidewall tiles are scribed and cut to butt against the front wall tiles, and the first sidewall tiles, the second sidewall tiles, and the front wall tiles are of a synthetic or natural material, and wherein the wall assembly is free of grout between adjacent tiles.

* * * * *